United States Patent [19]

König et al.

[11] 4,156,575

[45] May 29, 1979

[54] SAFETY DEVICE IN ROAD ROLLERS

[75] Inventors: Fritz König, Wuppertal; Heinrich Baier, Willich; Lucjan Geissler, Erkrath, all of Fed. Rep. of Germany

[73] Assignee: Losenhausen Maschinenbau AG, Fed. Rep. of Germany

[21] Appl. No.: 883,279

[22] Filed: Mar. 3, 1978

[30] Foreign Application Priority Data

Mar. 9, 1977 [DE] Fed. Rep. of Germany ..... 2710709

[51] Int. Cl.[2] ..... E01C 19/00

[52] U.S. Cl. ..... 404/84; 404/122; 200/61.91; 200/DIG. 1

[58] Field of Search ..... 404/84, 122, 123, 125, 404/126, 117, 131; 318/663, 676; 200/61.85, 61.91, DIG. 1

[56] References Cited

U.S. PATENT DOCUMENTS

| | | | |
|---|---|---|---|
| 2,133,173 | 10/1938 | Meyer | 404/123 |
| 3,156,989 | 11/1964 | Atkinson | 404/84 X |
| 3,247,771 | 4/1966 | Hanson | 404/84 |
| 3,339,468 | 9/1967 | Hall | 404/117 |
| 3,422,735 | 1/1969 | Vitry | 404/123 X |
| 3,431,832 | 3/1969 | Lang | 404/117 |
| 3,814,531 | 6/1974 | Carnahan | 404/117 |

*Primary Examiner*—Nile C. Byers, Jr.

*Attorney, Agent, or Firm*—Laney, Dougherty, Hessin & Beavers

[57] ABSTRACT

The invention relates to a safety device in road rollers, which have a guide rod with a guide handle so that they can be guided by an operator walking in front of or behind the road roller, and which are driven by an engine through drive transmission means arranged to be disabled, said safety device comprising a sensor element, which extends substantially along the length of the guide handle and responds to the operator grasping the guide handle, and further comprising servo means controlled by the sensor element and adapted to disable the drive transmission means upon releasing of the guide handle.

9 Claims, 5 Drawing Figures

SAFETY DEVICE IN ROAD ROLLERS

BACKGROUND OF THE INVENTION

1. Field of the Invention

This invention relates generally to safety control devices for road rollers, and more particularly, but not by way of limitation, to control apparatus, operating without displacement, responsive to the stray capacitance of a human operator.

2. Description of the Prior Art

Conventionally road rollers of the type mentioned hereinbefore, which are also called "walk-behind" or "pedestrian guided" road rollers, comprise a pair of roller drums mounted in a vehicle frame and driven by an engine in the form of an internal combustion engine, which is supported on the frame. In road construction such a road roller serves to compact and to smooth the roadmaking material applied for the construction of a road surface. The rotary movement is transmitted from the engine to the roller drum or drums through drive transmission means, which cause a step-down. The drive transmission means may comprise a mechanical gearing. However road rollers are also known in which the drive transmission means comprise a hydraulic pump coupled with the engine and having a pair of pump ports. The hydraulic pump pumps fluid (oil), which is supplied to a hydraulic motor in driving engagement with the roller drum. A guide rod is attached to the vehicle frame and has a guide handle at its end. This guide handle is grasped by the operator in order to steer the road roller. In addition setting means in the form of a setting lever are mounted on the guide handle and are arranged to vary the discharge flow of the hydraulic pump, which is usually an axial piston pump. The travelling speed of the road roller can be set continuously by varying the discharge flow of the road roller. In an idling or neutral position of the setting lever, the discharge flow of the hydraulic pump becomes zero (zero stroke position), whereby also the hydraulic motor and the roller drums are not driven.

In practical use such walk-behind or pedestrian guided road rollers involve considerable dangers for the operator. When the operator falls, in particular during reverse movement, he may be run over by the road roller which continues to move. There are regulations ("Grundsätze für die Prüfung der Arbeitssicherheit von Straßenbaumaschinen", issued by Hauptverband der gewerblichen Berufsgenossenschaften, Zentralstelle fur Unfallverhutung and Arbeitsmedizin, Fachausschuß "Tiefbau", Bonn, 2nd edition, September 1976) according to which an actuating element for easy and single-handed braking of the road roller has to be provided on such road rollers. The danger is, however, only insufficiently eliminated by such an actuating element, as the operator, when he has fallen, will usually not be able to reach this actuating element.

It is known to equip such road rollers with a "dead man's control". With prior art safety devices of this type, an energy storage spring is tensioned by the operator when setting the drive transmission means on forward or reverse drive. This energy storage spring is kept tensioned by the operator during operation of the road roller by means of a handle pawl. When this handle pawl is released this energy storage spring will relax and will cause disengagement of a clutch in the drive transmission means. Thereby the transmission of the drive movement from the engine to the roller drums is interrupted.

This prior art device suffers from several disadvantages:

Considerable actuating force is required for the tensioning of the energy storage spring. This means additional stress for the operator, which makes him look on this safety device, at first, as a nuisance and embarassment.

It is necessary to keep the handle pawl in its operative position, in which the energy storage spring is kept tensioned, during the whole operation of the road roller. This causes the operator to walk centrally in front of the guide rod. Thereby he will always be within the area of maximum risk.

It is practically impossible for the operator to exchange the hand with which he grips the guide handle, without inadvertently releasing the safety device and thereby disabling the drive transmission means. This constitutes an additional embarrasment in the operation of the road roller. If this disadvantage were to be avoided by replacing the handle pawl by a handle yoke, which extends all along the guide handle, this would involve the risk of the operator's hand being squeezed between guide handle and guide rod. Furthermore the guide handle with the handle yoke becomes so bulky that it is difficult to handle. This is disadvantageous in view of the steering forces required, which sometimes may be rather high.

When the road roller travels over uneven terrain and the guide rod swings up and down due to impacts, the operator will hardly be able to exert the retaining forces required for holding the handle pawl in its operative position continuously. In practical use this results in repeated unintentional releasing of the safety device and disabling of the drive transmission means.

All this involves the risk that the operator will simply tie the handle pawl or a handle yoke up, whereby the safety device becomes inoperative and the road roller would not be stopped in the case of emergency.

Furthermore the prior art safety device presents the problem that the energy storage spring causes only disengagement of a clutch, whereby the engine is disengaged from the roller drums. Thereby, however, the road roller will get out of control and may roll down a slope. Even if the operator should have walked uphill of the road roller, as ordered, the road roller rolling down would mean hazard for other persons and things.

It is an object of the invention to provide a safety device of the type defined in the beginning with which the actuation of the sensor during operation does not require any embarrassing actuating force.

Another object of the invention is to provide a safety device of the type defined in the beginning in which manipulation of the safety device in order to lock it, such as tying it up, is not possible.

A still further object of the invention is to eliminate the risk of the operator being hurt, when actuating the sensor.

Furthermore it is an object of the invention to avoid unintentional releasing of the safety device due, for example, to vibrations and impacts of the guide handle.

According to the invention the sensor member is a signal transmitter operating without displacement.

A signal transmitter operating with no displacement may be, for example, a circuit arrangement which responds to an electric shunt through the effective resistance of the operator's body, or which operates similar to an inductive approach sensor. It could be also an optical installation using a light pipe.

In a preferred embodiment of the invention the sensor element comprises a circuit responding to the operator's stray capacitance.

In contrast to the prior art device, no forces for actuating a handle pawl or a handle yoke have to be exerted with the no-displacement signal transmitter of the invention. Thus it is also not possible to lock the safety device by tying such actuating element up. Furthermore releasing due to inertial forces is not possible thanks to the no-displacement mode of operation.

In order to ensure that the fallen operator cannot be run over after having touched the guide handle again, for example if he tries to pull himself up with the help of the guide handle, reactivation blocking means may be provided, which respond to the returning of the setting means, for example of a setting lever, into its idling position and which are arranged to permit reactivation of the drive transmission means, after their being disabled by the sensor, only after the setting means have been returned intermediately into the idling position.

BRIEF DESCRIPTION OF THE DRAWINGS

An embodiment of the invention will now be described in greater detail with reference to the accompanying drawings.

DETAILED DESCRIPTION OF THE PREFERRED EMBODIMENTS OF THE INVENTION

The embodiment of the invention described hereinbelow is a road roller having hydrostatic drive transmission means and electric power supply.

Figure 4:
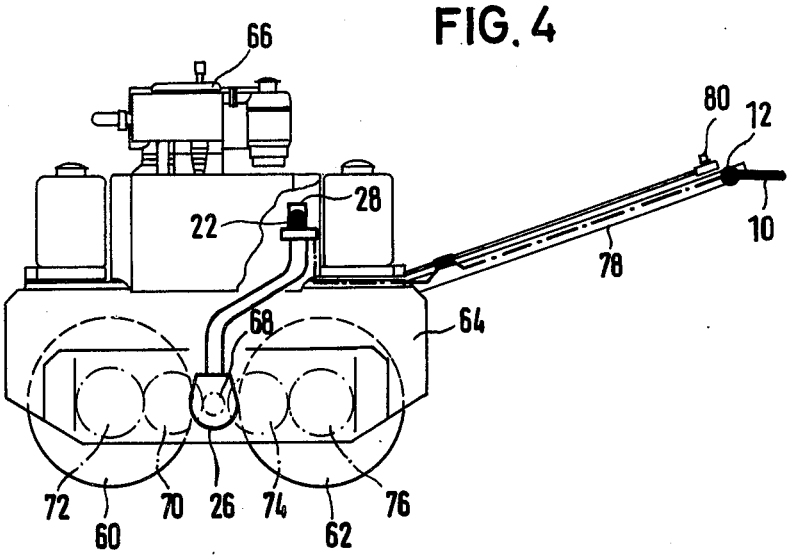
FIG. 4 is a side elevational view of a road roller with which the safety device of the invention is used.
Figure 5:
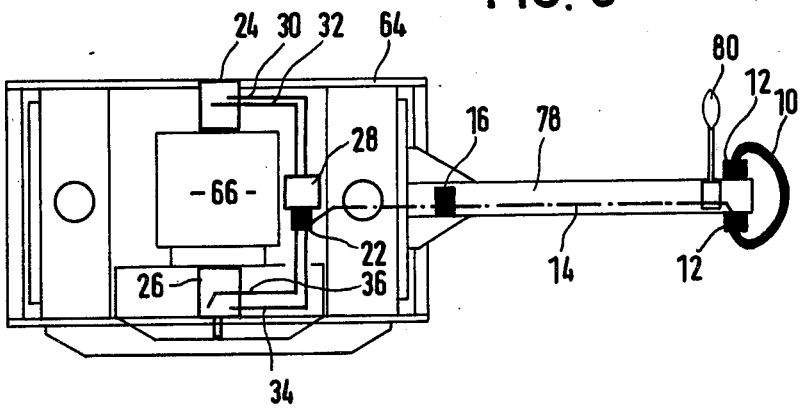

As can be seen from FIGS. 4 and 5, the road roller has two roller drums 60 and 62, which are mounted in a vehicle frame 64. An engine 66 in the form of an internal combustion engine is supported on the vehicle frame 64. The engine drives a hydraulic pump 24, which is a variable-delivery pump and may be, for example, an axial piston pump. The hydraulic pump 24 has pump ports 30 and 32 which are connected through hoses and a 4/2-directional control valve 28 to the motor ports 34 and 36 of a hydraulic motor 26.

Figure 2:
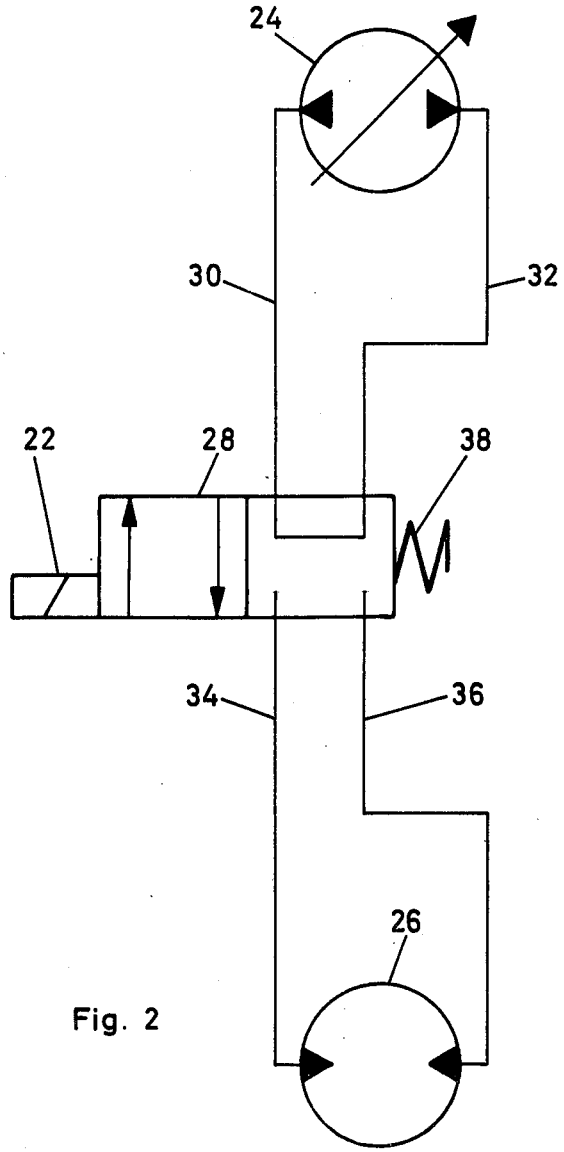
FIG. 2 shows the hydraulic circuit of the road roller.

The hydraulic pump 24, hydraulic motor 26, interconnecting hydraulic lines, and the control valve 28 comprise drive transmission means for selectively engaging and disengaging the engine drive means 66, by selective movement between a first position hydraulically connecting the motor 26 to the pump 24, and a second position, illustrated in FIG. 2, hydraulically disconnecting the motor 26 from the pump 24, and shutting off the hydraulic ports 34 and 36 of the motor 26.

The hydraulic motor 26 drives the two roller drums 60 and 62 through gear 68 and gears 70,72 and 74,76, respectively.

A guide rod 78 having a ring-shaped guide handle 10 is insulated from the guide rod 78 by insulators 12 and is connected through an electric conductor 14 to a circuit arrangement 16, which will be described hereinbelow with reference to FIG. 3. A setting lever 80 is mounted on the guide rod near the guide handle 10 as setting means for the drive transmission means.

A cam 18 is attached to the setting lever 80 and is arranged to close a switch 20 in the idling position, i.e. in the zero stroke position of the hydraulic pump 24.

Figure 1:
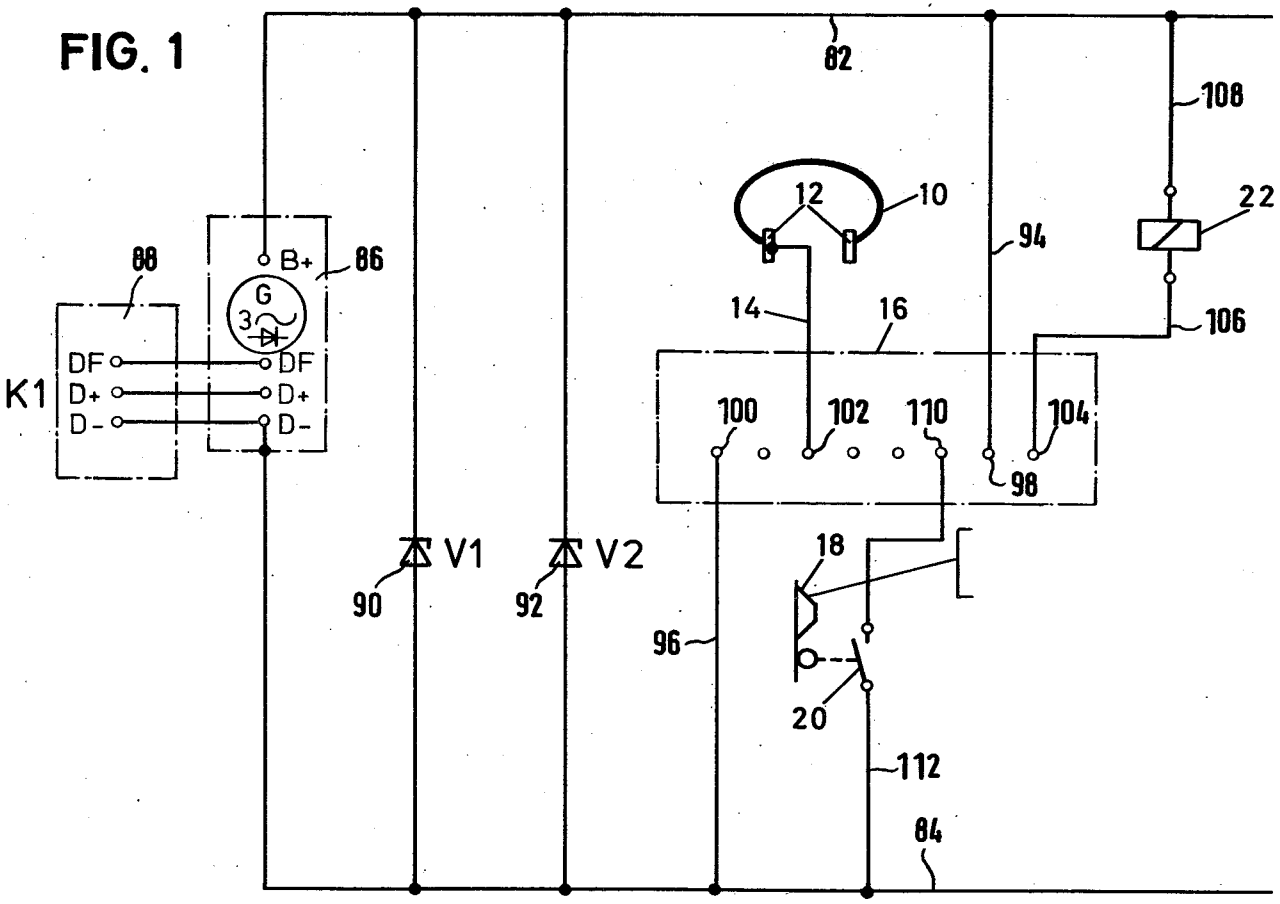
FIG. 1 shows schematically a wiring diagram of a safety device according to the invention.

The road roller has a power supply, which is represented in FIG. 1 by the two conductors 82 and 84. The power supply is fed by a generator 86, the voltage of which is controlled in conventional manner by a regulator 88. The diodes 90 and 92 limit the voltage of the power supply 82,84.

The circuit arrangement 16 receives a supply voltage from the conductors 82 and 84 through conductors 94 and 96, respectively, and input terminals 98 and 100, respectively. Conductor 14 is connected to an input terminal 102. The solenoid coil 22 of the solenoid valve 28 is connected to a terminal 104 through a conductor 106 and is connected, at the other end, through a conductor 108 to the conductor 82 of the power supply. Finally a terminal 110 of the circuit arrangement 16 is arranged to be connected to conductor 84 of the power supply through a conductor 112 and the switch 20.

Figure 3:
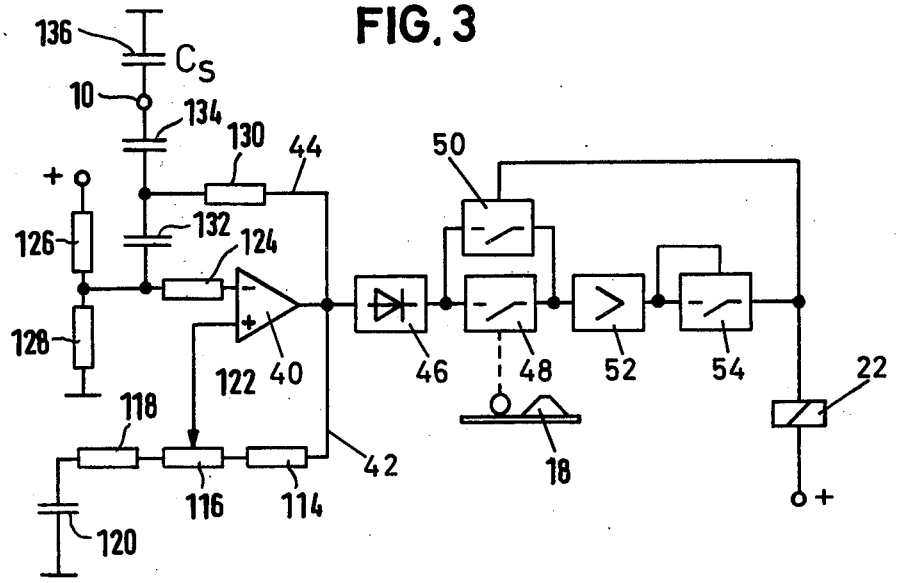
FIG. 3 shows an electric wiring diagram for generating a sensor signal and a servo signal.

Details of the circuit arrangement 16 are shown in FIG. 3

In FIG. 3 an operational amplifier 40 is wired up with a position feedback loop 42 and a negative feedback loop 44. The positive feedback loop comprises a fixed resistor 114, a potentiometer 116, a further fixed resistor 118 and a capacitor 120, which are connected in series between the output terminal of the operational amplifier 40 and ground. The slider of the potentiometer 116 is connected to the non-inverting input terminal of the operational amplifier 40. A fixed voltage, which is tapped from a voltage divider composed of fixed resistors 126 and 128, is applied to the inverting input of the operational amplifier 40 through a resistor 124. The voltage divider 126,128 is connected across the supply voltage. The negative feedback loop 44 comprises a fixed resistor 130 and a capacitor 132 which is connected to the junction between the resistors 124,126 and 128. In addition the negative feedback loop 44 comprises a capacitor 134 which, on one side, is connected to the junction between the resistor 130 and the capacitor 132 and, on the other side, is connected to the guide handle. The stray capacitance $C_s$ of the guide handle 10 is represented by a further capacitor 136 between the handle 10 and ground. This stray capacitance is increased, when a human operator touches the guide handle 10.

The circuit described is an oscillator circuit. When the operator does not touch the guide handle 10, the negative feedback loop 44 prevents the oscillator circuit from oscillating. When the operator touches the guide handle 10 part of the negative feedback voltage is diverted to ground due to the increase of the stray capacitance $C_s$. Thereby the oscillator circuit is caused to oscillate.

The high-frequency output signal of the oscillator circuit is rectified in a rectifier stage 46 and is applied to an amplifier stage 52 through two parallel switches 48 and 50. The output of the amplifier stage is supplied to the solenoid coil 22 of the solenoid valve 28 through a self-controlled power switch 54.

FIG. 2 illustrates the circuit of the hydrostatic drive transmission means. The drive transmission means comprise the hydraulic pump 24, which is a variable-delivery axial piston pump, and the hydraulic motor 26 for driving the roller drums 60 and 62. During operation the solenoid coil of the solenoid valve 28, which is a 4/2-directional control valve 28, is energized, and the 4/2-directional control valve 28 is in a first is at a substantially zero travelling speed and position, in which the pump ports 30 and 32 are connected to the motor ports 34 and 36 in a closed hydraulic circuit, the high pressure port of the hydraulic pump being connected to a high pressure port of the hydraulic motor 26. Upon de-energization of the solenoid coil 22, a return spring 38 will move the 4/2-directional control valve 28 into the second position illustrated, in which the two pump ports are "shunted" and communicate with each other and the two motor ports 34 and 36 are shut off. Thereby the hydraulic pump will operate with no-pressure circulation, and the drive means are blocked in both directions of movement, as pressure will build up in one of the two motor ports 34 or 36. The 4/2-directional control valve 28 will move into this second position also, when the engine 66 is switched off or the voltage of the power supply breaks down for some other reason.

The arrangement described operates as follows:

During normal operation the operator grasps the guide handle 10. Thereby part of the negative feedback voltage of the oscillator circuit of FIG. 1 is diverted due to the operator's stray capacitance, and oscillations of the oscillator circuit are excited. These oscillations are rectified by the rectifier stage 46. The setting lever is, at first, in its idling or neutral position, so that the switch 48 is closed. Therefore the voltage is supplied to the solenoid coil 22 and the 4/2-directional control valve 28 is moved into its first position, in which it establishes communication between hydraulic pump 24 and hydraulic motor 26. In the idling position of the setting lever 80, however, the pump does not yet deliver oil so that the road roller, at first, does not start to move. The voltage applied through switch 48 causes parallel switch 50 to close, whereby the solenoid coil continues to be connected to energizing voltage, when now the setting lever 80 is moved out of its idling position. Then the road roller continues to move into the selected direction as long as the operator continues to touch the guide handle 10.

When the operator releases the guide handle 10, for example because he has fallen, this will reduce the stray capacitance $C_s$. The negative feedback voltage increased thereby causes the oscillations of the oscillator circuit of FIG. 3 to be quenched, whereby the voltage at the output terminal of the rectifier stage 46 breaks down. Thereby the solenoid coil 22 of the 4/2-directional control valve 28 is switched off, and the 4/2-directional control valve 28 is moved into its second position as illustrated. Thereby, as described, the pump ports 30 and 32 of the hydraulic pump 24 are interconnected, and the motor ports 34 and 36 of the hydraulic motor 26 are shut off. Thus not only the engine 66 is disengaged from the roller drums 60 and 62, but the roller drums 60 and 62 are blocked by the hydraulic motor 26. Thus the arrangement, at the same time, acts as a braking device which is arranged to be actuated by the sensor element, namely the guide handle 10 and the circuit arrangement 16, simultaneously with the disabling of the drive transmission means. This braking device provides a means for retarding the rollers 60 and 62 of the road roller from rotating.

Due to the break-down of the voltage at the output of the rectifier stage 46, also switch 50 is opened again. When the operator now touches the guide handle 10 again, for example in order to pull himself up thereby, the oscillator circuit will start to oscillate again because of the reduction of the negative feedback, and an output voltage appears at the output terminal of the rectifier stage 46. This output voltage, however, does not become effective on the solenoid coil 22 of the 4/2-directional control valve 28 as long as the setting lever 80 has not been returned into its idling position. Switch 48 is opened until then, and also switch 50 parallel thereto remains open. Switch 48 is closed only after the setting lever 80 has intermediately been returned into its idling position, whereby the solenoid coil 22 energized and simultaneously switch 50 is closed. When the setting lever 80 subsequently is moved out of its idling position, the drive means will become affective again.

In a road roller in the form of a vibrating roller having a vibration generator, the vibration generator is preferrably arranged to be switched off by the sensor element simultaneously with the disabling of the drive transmission means.

In summary, the handle 10, as connected to the electrical circuit of FIGS. 1 and 3, comprises a sensing means, operating without displacement, for sensing the human operator's releasing of the handle 10. A signal from said sensing means causes solenoid coil 22 to be de-energized, thereby disengaging the drive transmission means. This simultaneously causes control valve 28, which is disposed in the hydraulic circuit connecting pump 24 and motor 26, to shut off ports 34 and 36 to hydraulic motor 26, thereby acting as a braking device.

The setting lever 80 provides a means for setting the travelling speed of the road roller, and includes an idle position. The parallel switches 48 and 50, and the associated circuitry shown in FIG. 3 provide a means for requiring the setting means 80 to be moved to its idle position to re-engage the drive transmission means. This may also be referred to as a re-activation blocking means.

The electrical circuit of FIGS. 1 and 3 comprises a control apparatus which may be summarized as follows. The handle 10 is a sensing means responsive to the stray capacitance $C_s$ of the human operator. The remainder of the circuitry of FIG. 3 comprises an electrical circuit means, connected to the sensing means, for actuating solenoid coil 22, or some other device which it is desired to control. The circuitry of FIG. 3 includes a means for conversion of a signal, from the sensing means, into a control signal and a switch means for connecting said conversion means to the solenoid coil 22.

The conversion means is comprised of rectifier 46 and an oscillator circuit made up of operational amplifier 40, positive feedback loop 42, and the negative feedback loop 44 to which said sensing means is connected.

The switch means includes a parallel switching circuit comprising first and second switches 48 and 50, which are preferably electronic switches. The first electronic switch 48 is actuated in the following manner. The human operator moves setting lever 80 to its idle position thereby closing mechanical switch 20 by engagement with cam 18 as shown in FIG. 1. An electrical signal from mechanical switch 20 actuates the first electronic switch 48. Next, the second electronic switch 50 is automatically closed by an electrical signal produced by the closing of the first electronic switch 48. The second electronic switch 50 is retained in that closed position until the signal flowing to solenoid coil 22 is interrupted, at which time switch 50 opens and remains open until the setting lever 80 is once again moved to its idle position.

Therefore, if the operator falls, releasing the handle 10, the drive transmission means is disengaged and the brake means is simultaneously actuated, so that the road roller cannot roll over the operator and injure him. The operator can reach up and grasp the handle 10 to pull himself up, without causing the drive transmission means to be re-engaged, because it is necessary to move the setting lever 80 to its idle position prior to re-engaging the drive transmission means.

Thus, the safety device in road rollers of the present invention is well adapted to carry out the objects and attain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A safety device, for road rollers of the type having engine drive means, transmission means for selectively engaging and disengaging said engine drive means, and a guide rod with a guide handle so that said road roller may be guided by a walking human operator, said safety device comprising:

means, operating without displacement, constructed for connection to said guide handle for sensing a human operator's releasing of said guide handle; and means, operatively associated with said sensing means, for moving said transmission means to a disengaged position in response to a signal from said sensing means.

2. The safety device of claim 1, further comprising:

means for setting the travelling speed of said road roller, said setting means including an idle position; and means for requiring said setting means to be moved to said idle position to re-engage said transmission means.

3. The safety device of claim 1 wherein said sensing means comprises:

an electrical circuit responsive to a stray capacitance of said human operator.

4. The safety device of claim 3, wherein:

said electrical circuit includes an oscillator circuit having feedback means; and said guide handle is further characterized as being electrically insulated from said guide rod, and as being electrically connected to said feedback means of said oscillator circuit, so that said oscillator circuit is caused to oscillate in response to said human operator's stray capacitance.

5. The safety device of claim 1, further comprising:

brake means for retarding the rollers of said road roller from rotating; and means for actuating said brake means simultaneously with the disengagement of said transmission means.

6. The safety device of claim 1, wherein:

said transmission means includes a hydraulic pump driven by said engine drive means, a hydraulic motor for driving the rollers of said road roller, and hydraulic circuit means connecting said hydraulic pump and hydraulic motor; and said safety device further comprises a brake for the rollers of said road roller, said brake including a control valve means, disposed in said hydraulic circuit means, for selective movement, in response to a signal from said sensing means, between a first position hydraulically connecting said motor to said pump, and a second position disconnecting said motor from said pump and shutting off a pair of hydraulic ports of said motor.

7. The safety device of claim 6, wherein said control valve means comprises:

a solenoid valve characterized as being energized when said control valve means is in said first position.

8. The safety device of claim 1, wherein said road roller is a vibrating roller having a vibration generator, said safety device further comprising:

a switch for turning off said vibration generator simultaneously with the disengagement of said transmission means.

9. A road roller comprising:

a frame;

a roller drum, mounted upon said frame;

engine drive means, mounted upon said frame;

drive transmission means, having a first engaged position connecting said engine drive means to said roller drum, and a second disengaged position where said engine drive means is disconnected from said roller drum;

a guide rod, attached to said frame;

a guide handle, attached to said guide rod, so that said rod roller may be guided by a human operator;

sensing means, responsive to said human operator's grasping and releasing of said guide handle;

means, operatively associated with said sensing means, for moving said transmission means to said second disengaged position in response to said human operator's releasing of said guide handle;

setting means for varying the travelling speed of said road roller, said setting means having an idle position wherein said transmission means is in its first engaged position and said travelling speed is substantially zero; and re-activation blocking means for requiring said setting means to be moved to said idle position to move said transmission means back to said first engaged position subsequent to said transmission means having been in said second disengaged position.

* * * * *

UNITED STATES PATENT OFFICE

CERTIFICATE OF CORRECTION

Patent No. 4,156,575 Dated May 29, 1979

Inventor(s) Konig, et al

It is certified that error appears in the above-identified patent and that said Letters Patent are hereby corrected as shown below:

Column 4, line 27, cancel "position" and insert --positive--. Column 5, lines 3 and 4, delete "is at a substantially zero travelling speed and"; Column 5, line 35, after "first," insert --is at a substantially zero travelling speed and--. Column 6, line 14, delete "affective" and insert --effective--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*